US008231004B2

(12) United States Patent
Port et al.

(10) Patent No.: US 8,231,004 B2
(45) Date of Patent: Jul. 31, 2012

(54) UNIT LOAD FOR THE TRANSPORT OF ABSORBENT HYGIENE ARTICLES

(75) Inventors: Markus Port, Steinbach am Taunus (DE); Ibrahim Ulas, Rossert Strassel, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 136 days.

(21) Appl. No.: 12/432,077

(22) Filed: Apr. 29, 2009

(65) Prior Publication Data

US 2009/0277901 A1 Nov. 12, 2009

(30) Foreign Application Priority Data

May 9, 2008 (EP) ..... 08103887

(51) Int. Cl.
*B65D 19/00* (2006.01)
*B65D 85/16* (2006.01)
*B65D 71/10* (2006.01)

(52) U.S. Cl. ..... 206/597; 206/440; 206/494; 206/497

(58) Field of Classification Search ..... 206/386, 206/494, 497, 595–600, 440, 453, 586
See application file for complete search history.

(56) References Cited

U.S. PATENT DOCUMENTS 2,750,033 A * 6/1956 Pickens ..... 206/440
3,522,688 A * 8/1970 Kaliwoda et al. ..... 206/497
3,650,459 A * 3/1972 Tucker ..... 206/599
4,244,471 A * 1/1981 Plante ..... 206/386
4,919,270 A * 4/1990 Govang et al. ..... 206/597
4,934,535 A * 6/1990 Muckenfuhs et al. ..... 206/494
5,161,692 A 11/1992 Knierim
5,251,753 A * 10/1993 Pigott et al. ..... 206/597
5,271,498 A * 12/1993 Gillespie ..... 206/497
5,307,928 A 5/1994 Bishop
5,380,094 A * 1/1995 Schmidt et al. ..... 206/494
5,624,031 A 4/1997 Fowler et al.
5,967,665 A * 10/1999 MacDonald et al. ..... 206/494
6,026,957 A * 2/2000 Bauer et al. ..... 206/494
6,357,587 B1 3/2002 Melms, Jr.
6,454,095 B1 * 9/2002 Brisebois et al. ..... 206/494
6,708,823 B2 * 3/2004 Cottingham et al. ..... 206/440
6,913,146 B2 * 7/2005 Bechyne et al. ..... 206/440
2007/0045153 A1 3/2007 Bautista et al.
2007/0295629 A1 12/2007 Adriaanse et al.

OTHER PUBLICATIONS

PCT International Search Report dated Jun. 24, 2009.

* cited by examiner

*Primary Examiner* — Bryon Gehman
(74) *Attorney, Agent, or Firm* — Andres E. Velarde

(57) ABSTRACT

Unit load for transporting absorbent hygienic articles such as sanitary pads. The unit load includes a pallet, a bottom tray with one or more side flaps folded upwardly, a plurality of secondary packages loaded on the pallet and forming a stack, a top cap on top of the stack with one or more side flaps folded downwardly, and a plurality of corner posts each placed against a different vertical corner of the stack of secondary packages. A secondary package for transporting feminine hygiene articles, in particular sanitary pads, made of a flexible material is provided.

12 Claims, 18 Drawing Sheets

UNIT LOAD FOR THE TRANSPORT OF ABSORBENT HYGIENE ARTICLES

FIELD OF THE INVENTION

The invention relates to a unit load for the transport of absorbent hygiene articles, in particular feminine hygiene articles such as sanitary pads. The invention allows this type of products to be transported over long distance, for example between the production plant to a retailer's distribution center, using the conventional pallet and container system, but at a reduced costs and improved handling convenience compared to the current unit load.

BACKGROUND OF THE INVENTION

The global trend for the concentration of industrial production means that products have to be transported for ever increasing distances before reaching their consumers. With the increasing removal of trade barriers between countries and the decreasing cost of long distance shipping, products that were once considered too bulky and costly to transport over long distances are now routinely exported from other countries or even other continents to the consuming countries.

Most products are nowadays transported from their production site to a distribution center or supermarkets using the pallet/container system. A pallet is a flat transport structure that supports goods in a stable fashion and that can be easily lifted by a forklift, pallet jack, or other jacking device, for example within a container which is then transported by ship, train or truck. Pallets loaded, sometimes called unit load, with goods can also be stacked on another, thus reducing the surface needed in the warehouse, if the nature of the products allows.

Corner posts are elongated piece of rigid material bent at an angle, usually 90°, which are sometimes used to protect the edges of unit loads from scratches or other impacts during transport. More elaborated corner posts system have been proposed for the protection of bulky and heavy objects such as furniture unit, see for example U.S. Pat. No. 6,357,587B1. U.S. Pat. No. 5,161,692 discloses an open-sided container apparatus including a cap member having an internal divider wall forming pockets for receiving corner posts having bottom endwalls for cushioning the corners of an appliance. U.S. Pat. No. 5,307,928 discloses a container for shipping household appliances such refrigerators, washers, dryers and the like comprising a top cap, a separate bottom support and four separate corner posts.

Sanitary pads, also called sanitary napkins, are usually sold to the consumers in a primary package comprising a certain amount of pads, usually between 8 and 20. This primary package is usually made of a plastic film. Primary packages are usually bundled at the production site in a secondary package, which usually comprises from 10 to 20 primary packages. Secondary packages are usually made of a corrugated fiberboard box. The interest of using a secondary package is multiple. For example, the secondary package allows the staff of a supermarket to more quickly and efficiently replenishes a shelf than what would otherwise be the case if individual packs of sanitary pads had to be carried from the warehouse to the shelf. Also, sanitary pads are relatively fragile and pressure sensitive, and need to be protected during transport from excess pressure, otherwise the primary packages and the sanitary pads contained therein may arrive in a crumbled state to the point of sale. A rigid secondary package protects the pressure sensitive primary package and their content from damage during transport and storage.

Until now, it has been standard practice to use a box made of corrugated fiberboard as secondary package for sanitary pads. One reason for using corrugated fiberboard boxes is that this type of package is relatively rigid (it will not deform under the usual load experienced during transport and storage) and thus can be used for palletizing. Corrugated boxes can easily support the weight of several other boxes, and if necessary the weight of another loaded pallet that may be stored on top of the first palletized unit.

The current package system for sanitary pad is not without inconvenients. First, the material used to make the corrugated fiberboard boxes is relatively bulky, and adds to transport and disposal costs for the manufacturer and the retailer. Second, opening the corrugated fiberboard boxes can be time consuming for the staff of a supermarket. Third, the corrugated fiberboard material used is sensitive to humidity, and its physical properties can be impacted by environmental conditions such as humidity. Fourth, corrugated fiberboard material may not be impervious to dust. Fifth, the price of fiberboard is increasing. It would therefore be desirable to find a transport system for sanitary pads and other absorbent hygiene articles that provide the same or better protection to the articles during transport as paperboard boxes, but at a lower costs and greater convenience for the staff handling these articles.

SUMMARY OF THE INVENTION

In a first aspect, the invention is for a unit load for absorbent hygienic articles in particular feminine hygienic articles such as sanitary pads, as defined in claim 1. In particular, the unit load comprises a pallet, a bottom tray with one or more side flaps folded upwardly, a plurality of secondary packages loaded on the pallet and forming a stack, a top cap on top of the stack with one or more side flaps folded downwardly, and a plurality of vertical corner posts each placed on a different vertical corner of the stack of secondary packages. Each secondary package contains a plurality of the primary packages to be transported. The corner posts extend vertically at least from the bottom edge to the top edge of the stack of secondary packages and are placed against at least a portion of the folded flaps of the bottom tray and of the top cap. The secondary package is made of a flexible material, preferably a plastic film.

In a second aspect, the invention is for a method of making a unit load for the transport of absorbent hygiene products such as feminine sanitary pads as indicated in the claims, wherein the steps can be performed in any orders unless necessarily otherwise.

In a further aspect, the invention is for a secondary package for transporting feminine hygiene articles, in particular sanitary pads, made of a flexible material, preferably a plastic film, as indicated in the claims. This secondary package may be used with the unit load according to the invention.

In a further aspect, the invention is for a piece of foldable material as indicated in the claims. This piece of foldable material may be used as a bottom tray or as a top cap in a unit load according to the invention.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and in which:

DETAILED DESCRIPTION OF THE INVENTION

Figure 1:
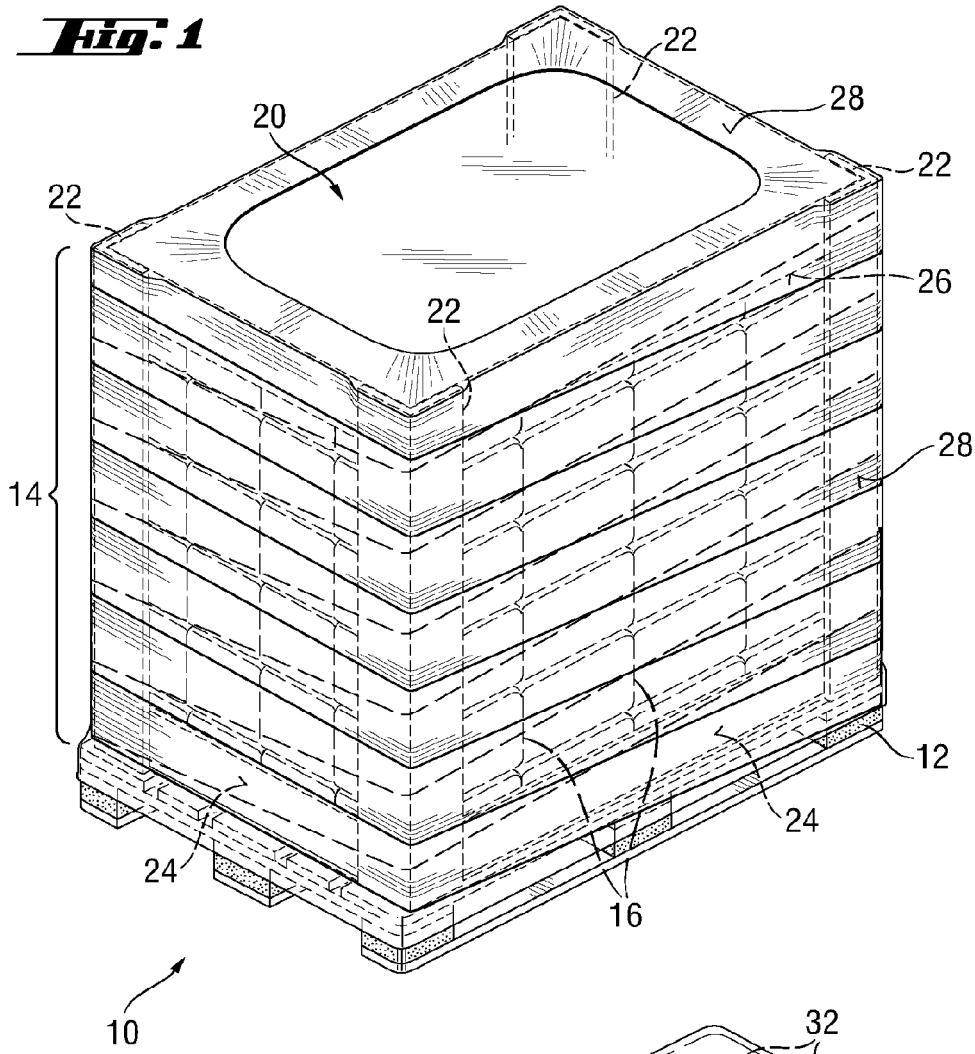
FIG. 1 is a perspective view of an embodiment of the unit load of the present invention.

FIG. 1 shows an embodiment of a unit load 10 according to the invention. The unit load 10 as shown in FIG. 1 comprises a pallet 12, a stack 14 of secondary packages 16 loaded on the pallet 12, a bottom tray 18 placed between the pallet 12 and the stack 14, a top cap 20 disposed on the top of the stack 14, and corner posts 22 placed along the vertical corners of the stack. The bottom tray 18 comprises flaps 24 that are folded upwardly, and the top cap 20 comprises flaps 26 that are folded downwardly. As represented, the corner posts 22 may be maintained in position against the corners of the stack by a stretch wrap or shrink wrap 28. The particular embodiment of FIG. 1 will now be discussed in further details.

Figure 5:
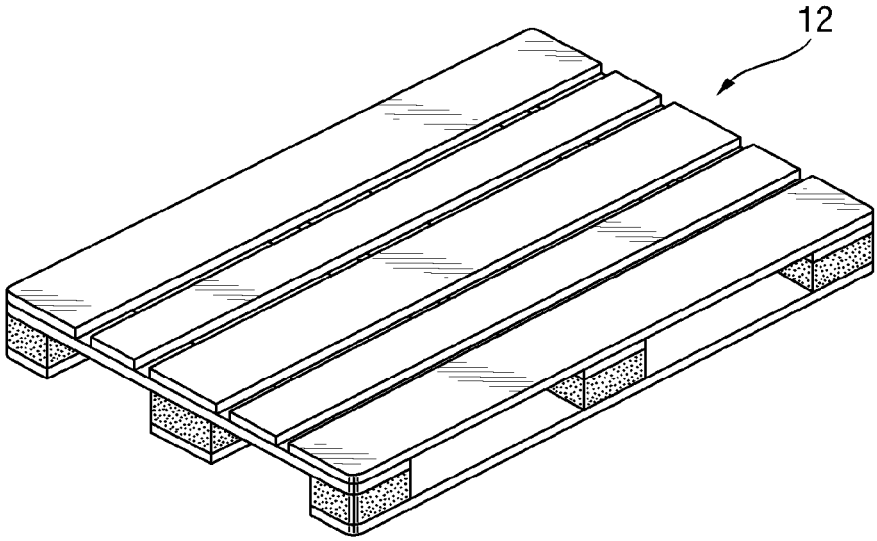
FIG. 5 to FIG. 16 are perspective views showing different stages of construction of the embodiment of FIG. 1.

The unit load 10 of the invention comprises a pallet 12, which may be any standard pallet normally used for transporting goods, for example as represented in FIG. 5. Pallets are commonly made of wood or plastic material, in general materials that are sufficiently resistant and cheap for the intended use. The size and properties of pallets are normally standardized in a given region. For example in Europe, a standard pallet has a surface of about 800 mm×1200 mm and a height of 150 mm. However, the present invention is not limited to a specific type of pallet but is applicable across a wide range of pallet types. Pallets normally comprise grooves for allowing manipulation of the unit load by a fork lift. As used herein, the term "unit load" refers to an individual pallet and its load.

Figure 10:
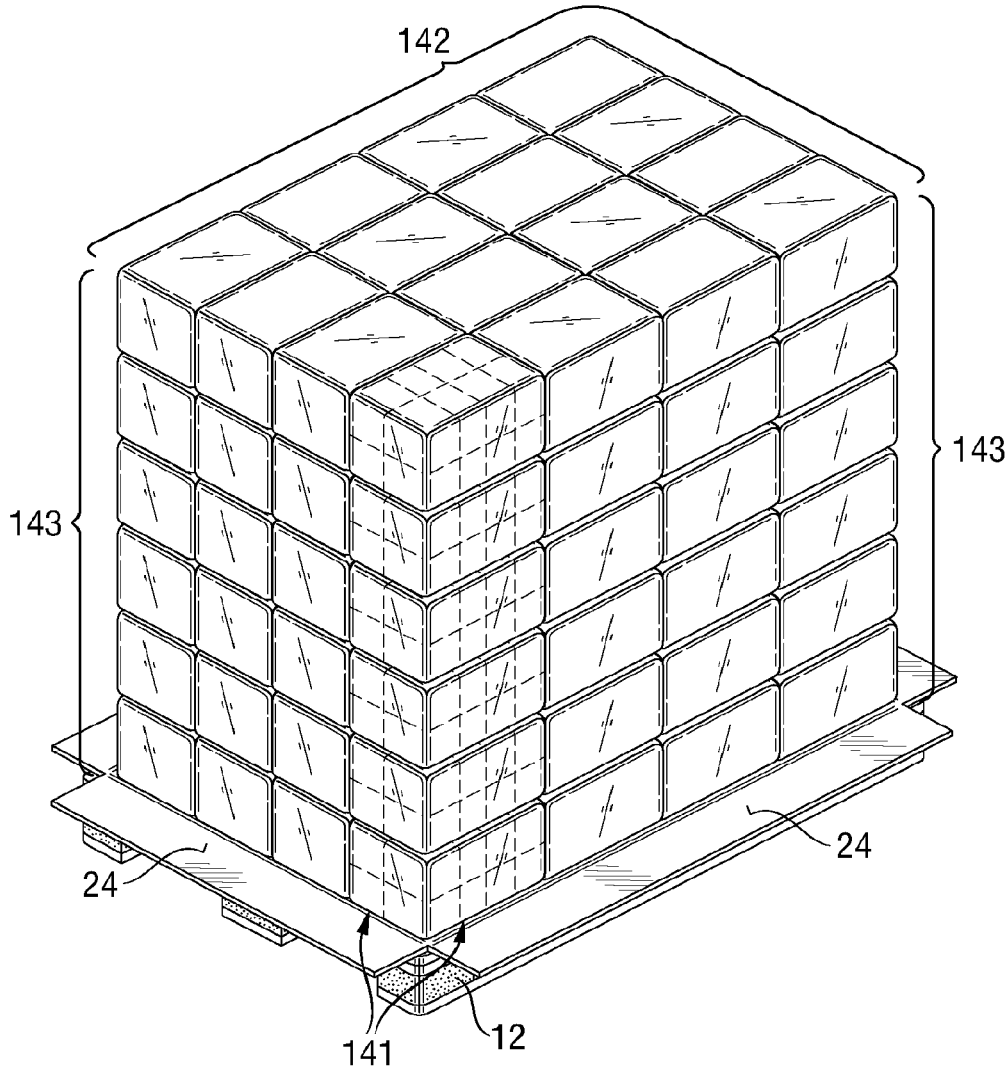

As shown on FIG. 1 and FIG. 10 for example, a stack 14 of secondary packages 16 is loaded on the pallet 12. The stack comprises a bottom edge 141, defined by the periphery of the first, bottommost, layer of secondary packages, and a top edge 142 defined by the periphery of the last, uppermost, layer of secondary packages. The stack comprises a plurality of vertical corners 143 between the bottom edge and top edge. Normally, the stack will have a generally constant rectangular cross-section in the horizontal plane, and the bottom edge 141 and top edge 142 of the stack will have four sides, and four vertical corners 143.

Figure 2:
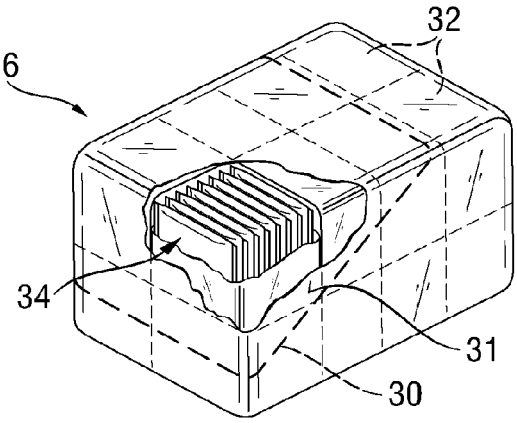
FIG. 2 is a perspective view of a secondary package that can be used in the transport system shown on FIG. 1.
Figure 2A:
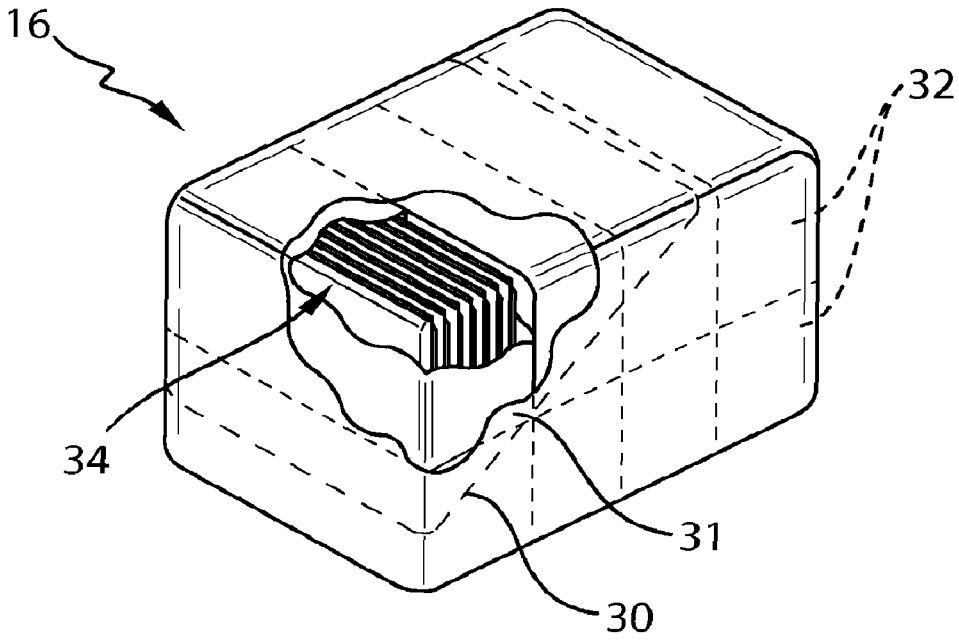
FIG. 2*a* is a perspective view of a secondary package that can be used in the transport system shown in FIG. 1.

The secondary package 16 is shown in more details in FIG. 2. The secondary package 16 contains a plurality of primary package 32 with absorbent hygiene articles. The secondary package 16 is made of a flexible material. By "flexible" we mean that the secondary packaging does not protect its content from crushing in normal storage and transport conditions, unlike standard box-shaped secondary packaging made of corrugated board. The secondary packaging of the invention may advantageously be light-weight, cheap and recyclable and can be made of any flexible material common in the field of packaging, such as plastic films, for example a polyethylene film, and paper sheets, and may be made by any conventional manufacturing methods in the bagging field. For example a paper bag may be used as secondary packaging. A secondary packaging made of a plastic film may advantageously be made by a flow wrap process, but other processes may also be used such as a shrink film or film sleeve process.

Opening means such as a pre-ruptured line 30 may be present for facilitating the opening of the secondary package 16. The pre-ruptured line 30 may define a removable surface 31 on the secondary packaging 16. The surface 31 may represent from about 10% to about 45%, or from about 20% to about 35% of the overall surface of the secondary packaging. The secondary package 16 can be for example placed directly on the shelf of a retailer with the surface 31 removed. The remaining part of the secondary package then holds the primary packages 32 together while the removed surface 31 allows easily removal of the primary package contained therein, for example by a prospective buyer. The pre-ruptured line 30 may extend across four sides of the secondary package. In one embodiment, for each side of the secondary package where the pre-ruptured line is present, the removable surface 31 for that side may not represent more than three quarter of the surface of that side, in order that sufficient material remains in order to keep the plurality of primary packages in a stable conditions.

The primary package 32 may be a consumer unit, i.e. the individual unit that is usually sold individually to the consumer. For feminine hygiene articles such as sanitary pads for example, a primary package may usually contain from 4 to 60 absorbent pads, with most products being sold with a count of between 8 and 28 pads. The primary package may have any suitable shape. For feminine hygiene articles, the primary package usually has a generally cubic shape, or for the so-called double pack a size which is roughly equivalent to the juxtaposition of two cubes. The primary package may be made of a plastic film, as is usual in the trade.

The primary package 32 contains a plurality of absorbent hygiene articles 34. The term "absorbent hygiene article" refers to the kind of personal articles used for absorbing body exudates. The absorbent hygiene articles may be for example feminine hygiene articles such as feminine pads, pantiliners, light incontinence products, or infant diapers. These articles are normally relatively soft and compressible, and can suffer during transport and storage if they are not properly protected.

Figure 3:
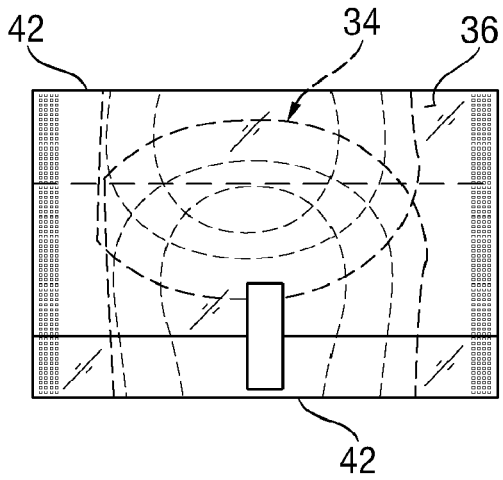
FIG. 3 is a front view of a feminine hygiene pad and its wrapper.
Figure 4:
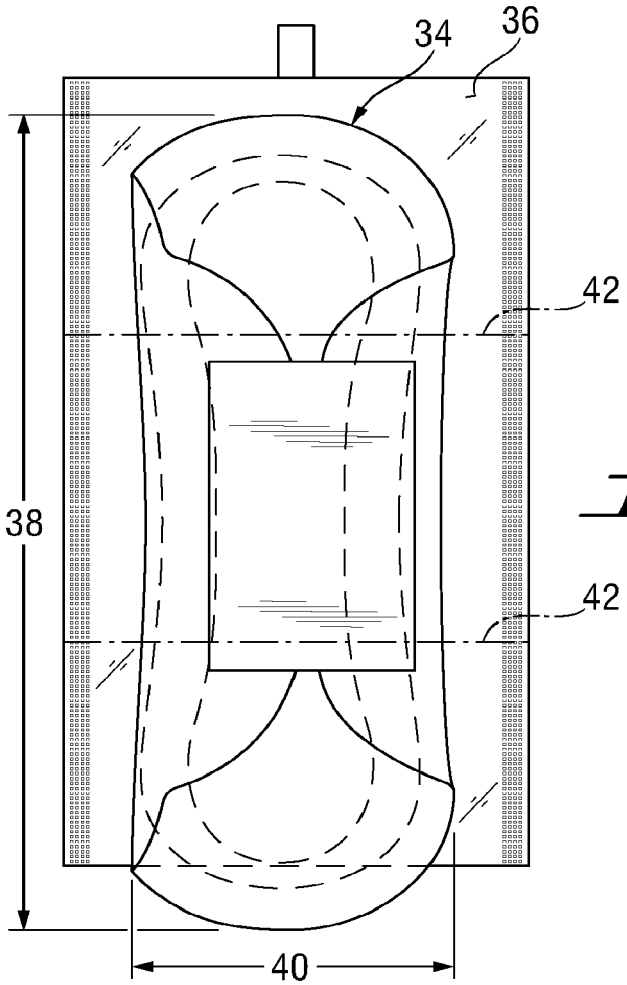
FIG. 4 is a front view of the feminine hygiene pad of FIG. 3 with the wrapper open.

The absorbent hygiene article may be for example a sanitary pad 34, as represented on FIG. 3 and FIG. 4. Sanitary pads (also called napkins) are products designed to absorb feminine exudates such as menses from the pudental area of the woman. "Ultra" thin pads are relatively thin pads that comprise an absorbent core usually comprising a fluff matrix containing superabsorbent polymer materials dispersed within. The so-called "thick" pads are relatively thicker and usually do not comprise superabsorbent polymers in the core. The invention is advantageously used for feminine absorbent hygiene articles, in particular sanitary pads, which are more sensitive to crushing than diapers, for example.

Many feminine pads are sold in a folded form as shown in FIG. 3. The folded pad 34 may be further wrapped in an individual plastic film 36 for protection from contamination prior to use and hygienic disposal of the used pads, but pads are also sometimes sold without an individual plastic film for cost reasons. FIG. 4 shows a typical pad 34 in an unfolded configuration. The absorbent hygiene article (in the unfolded shape if sold folded) such as the pad 34 may have a length 38 and a width 40 and at least one fold line 42 as shown in FIG. 4.

When the absorbent hygiene article 34 is folded along one or more folding lines 42 as exemplary represented on FIG. 3, it may be advantageous to orient the absorbent articles in the unit load vertically (i.e. not flat) with the fold lines being orientated in a horizontal plane, as represented on FIG. 2. In other words, if the article (for example a pad) is folded along its length (as is normally the case), the folded pad length is orientated vertically. It was found that the folded absorbent articles 34 are more stable in this direction, and thus can better support the pressure of the overlaying package. If the folded articles are orientated flat in the unit load, then the folded articles lying on the bottom of the stack may be unduly compressed. If the folded articles are orientated with the folded pad length orientated horizontally, then the stability of the articles and thus of the stack may be compromised, with the possibility of unwanted deformation of the articles occurring. However, this orientation may not be a serious issue in many cases, so that this advantageous orientation is not necessary for the invention to be performed.

In embodiments wherein the hygiene absorbent article is not folded, then it may be advantageous to have the width of the articles orientated vertically, as the resistance to deformation of the article along its width will be generally be higher than across its length for unfolded articles.

The plurality of secondary packages 16 loaded on the pallet 12 form a stack 14, which may be of a generally cuboid shape as shown on FIG. 10. The stack 14 may be comprised of several layers 43. The dimensions of the stack 14 and the number of secondary packages 16 in the stack may be chosen to allow the maximum number of secondary packages to be loaded on a given pallet, for economic reasons. The number of layers of secondary packages is not critical and can vary, for example from 2 to 12 layers. If the unit load is to be shipped by truck or train, for example a number of 4 to 6 layers may be usual. For overseas shipment by boat, the stack may have a higher number of layers. The number of secondary packages 16 per layer is also not critical, and may be adapted to the circumstances such as the size of the secondary package and the dimension of the pallet, for example from 4 to 30 secondary bags per layer 43.

The stack 14 normally has four vertically orientated corners 143. According to the present invention, a corner post 22 is placed on at least one of these vertically orientated corners. Advantageously, each of the vertical corners 143 of the stack 14 has a corresponding corner post 22 placed along it as shown on FIG. 14. One of the functions of the corner posts 22 is to support any pressure or weight that may be applied on top of the unit load, so that the absorbent articles in the unit load do not suffer from an excessive pressure and are not deformed during storage or transportation. Advantageously, the corner posts are sufficiently rigid to support at least another unit load of similar or same weight staggered on the top of the unit load, as is represented on FIG. 17. By being able to support, we mean that the corner posts will not significantly deform during storage and transportation under normal conditions. Advantageously, the corner posts can collectively support a weight load of at least 300 kg without significant deformations.

The corner posts 22 can be made of any sufficiently rigid material, such as cardboard or plastic, or a composite of extruded plastic material with a cardboard finish to allow printing of the surface.

The corner posts extend vertically at least from the bottom edge to the top edge of the stack. The corner posts can extend vertically above the top of the stack if the stack does not reach the top of the corner post. This may be the case when it is found more economical to have a single length for the corner posts within a production site, so that the corner posts do not need to be adapted to different unit loads. Of course, where the corner posts are higher than the stack 14 of secondary package, the gap between the top of the stack and the top of the corner posts may normally represent a distance less than the height of one layer of secondary packages, otherwise another layer of secondary packages may be added to the stack for optimal volume utilization.

As will be discussed in more details below, the unit load 10 comprises a bottom tray 18 and a top cap 20. The bottom tray 18 is placed between the pallet 12 and the stack 14 of secondary packages 16, and comprises one or more side flaps 24 that are folded upwardly around one or more sides of the bottom edge 141 of the stack 14. A top cap 20 is placed on top of the stack 14. The top cap 20 comprises one or more side flaps 26 that are folded downwardly around one or more sides of the top edge 142 of the stack. The bottom tray 18 and top cap 20 may be made of any suitable material. Corrugated fiberboard was found particularly useful since it is light weight but sufficiently rigid, and can also be cut in a flat shape with the side flaps 24, 26 extending from a central body 44, with the side flaps easily foldable around the stack of secondary packages. It was found that bottom tray 18 and top cap 20 provide increased stability to the unit load, in particular the folded side flaps 24, 26 provide an anchorage point for the corner posts 22 and help maintaining the corner posts 22 in a vertical position. The central body may have a surface area of at least 1 square meter.

Further aspects of the invention and more details regarding the first aspect will now be described with reference to FIGS. 5 to 16, which discloses an exemplary embodiment of a method of making a unit load according to the invention.

FIG. 5 shows an exemplary pallet 12. Any pallets including standard pallet may be used in the present invention.

Figure 6A:
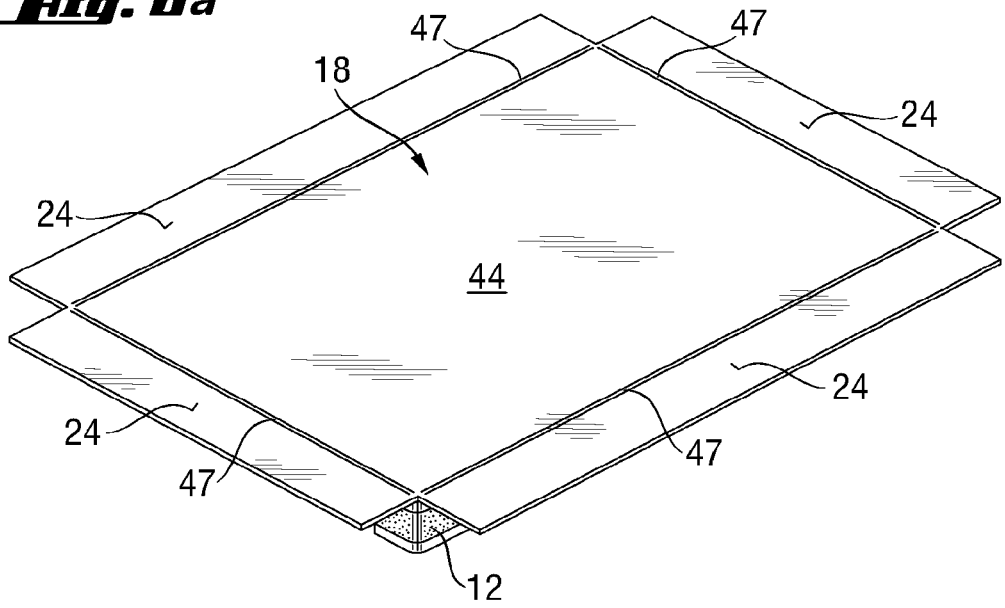

FIG. 6*a* shows an exemplary first stage of the unit load construction a bottom tray 18 is placed on the pallet 12. The bottom tray 18 may for example be made of corrugated fiberboard or cardboard. The bottom tray 18 may be placed on the pallet 12 in a flat configuration, with the side flaps 24 extending outwardly horizontally from the central body 44 of the bottom tray 18.

The bottom tray 18 advantageously has four flaps 24 extending from each side of the central body 44, as exemplarily represented in FIG. 6*a*. Other configurations are possible, for example only one flap, or only two flaps on opposite sides of the central body, or wherein two smaller flaps separated by a gap are provided instead of a single flap continuously extending across the length of one side of the central body. The length of the flaps in the outward direction may vary, generally it is expected that a length of between about 5 and 25 cm will be suitable, for example 15 cm.

The central body 44 of the bottom tray 18 may be generally contiguous with the surface of the pallet as shown in FIG. 6*a*. A crease line 47 may be provided between each side flap and the central body of the bottom tray for making the folding of the side flaps around the bottom edge of the stack easier. In the embodiment shown in FIG. 6*a*, the footprint of the stack (i.e. the surface of the first layer of secondary packaging) matches approximately the surface of the pallet 12 and the surface of the central body 44 of the bottom tray 18 and top cap 20.

In other embodiments however, the footprint of the stack may be significantly smaller than the surface of the pallet. In these other embodiments, there may be relatively large gaps (a few cm or more) between the stack 14 and the frame formed by folded tray 18, cap 20 and corner posts 22, which may cause a certain instability of the structure of the unit load.

One solution to this problem is to have differently sized bottom tray and top cap, each adapted for different stack with different footprints. However it may not be practical and economical to have differently sized bottom trays and top caps in a production site.

Figure 6B:
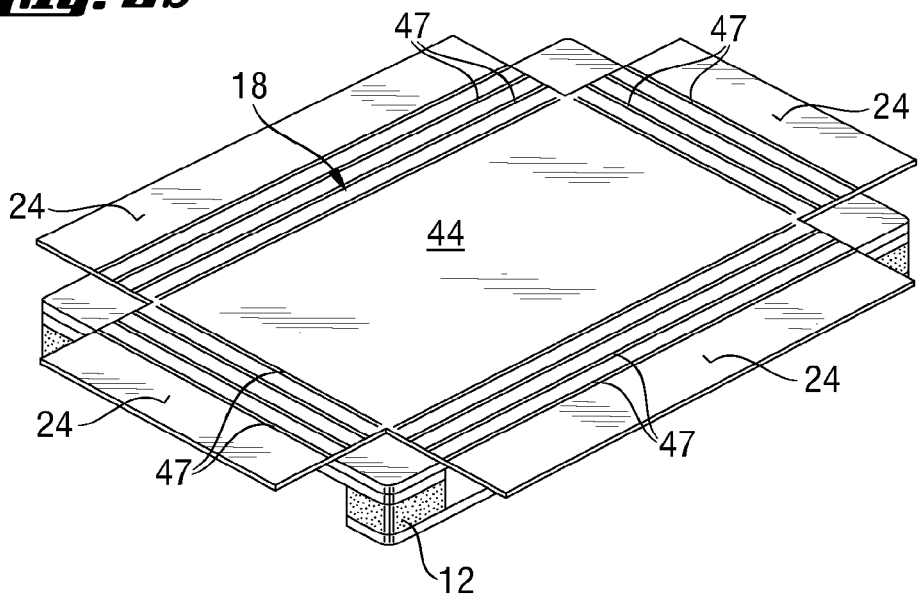

Rather, the inventors have found that it may be beneficial to have a versatile bottom tray and a versatile top cap capable of fitting different stacks having different footprints. Such a tray or cap is represented in FIG. 6*b*. In the embodiment of FIG. 6*b*, the surface of the central body 44 is smaller than the surface of the pallet on which it is intended to be used, for example less than about 5% or less than about 10% of the surface of the pallet.

In the embodiment of FIG. 6*b*, a portion of each side flaps 24 is present within the area defined by the surface of the pallet. This portion of the flaps within the area defined by the pallet's surface is provided with several crease lines 47. The crease lines 47 may be parallel and extend across the width of each flap 24. The crease lines may be separated by a regular gap, for example 1 cm between each crease line. The portion of the flaps extending outside of the pallet may have the same size as the embodiment represented in FIG. 6*a*. The portion of the flaps within the surface of the pallet may have for example a length of between about 2 and about 10 cm, for example 5 cm, and each flap may for example overall comprises from about 2 to about 10, or about 3 to about 6, crease lines per flap. The crease lines facilitate the folding of the flaps and may be made by any conventional means, for example local compression of the material making the bottom tray/top cap. This plurality of crease lines defines a plurality of folded configurations, which can therefore be adapted for stacks having different footprints.

The side flaps 24 may be easily folded upwardly, especially if one or more crease lines 47 have been provided. It is also envisaged that instead of having a bottom tray initially in a completely flat configuration, a bottom tray with already folded side flaps may be provided. In that case, materials other than foldable material may be used for the bottom tray, such as molded rigid plastic or expanded polystyrene. However, it was found that using a bottom tray with foldable flaps, for example made of corrugated fiberboard, was advantageous for cost reasons, as well as versatility as the bottom tray may be adapted to the footprint of each stack. Also using an initially flat bottom tray is advantageous because these take less storage place and are easier to transport than preformed tray.

Figure 7:
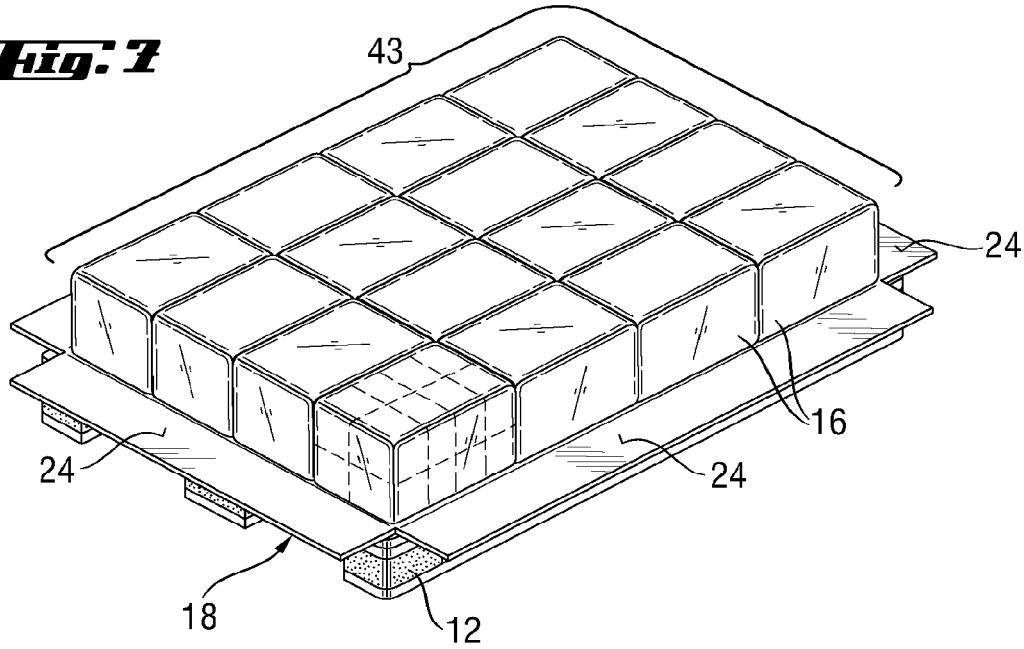
Figure 8:
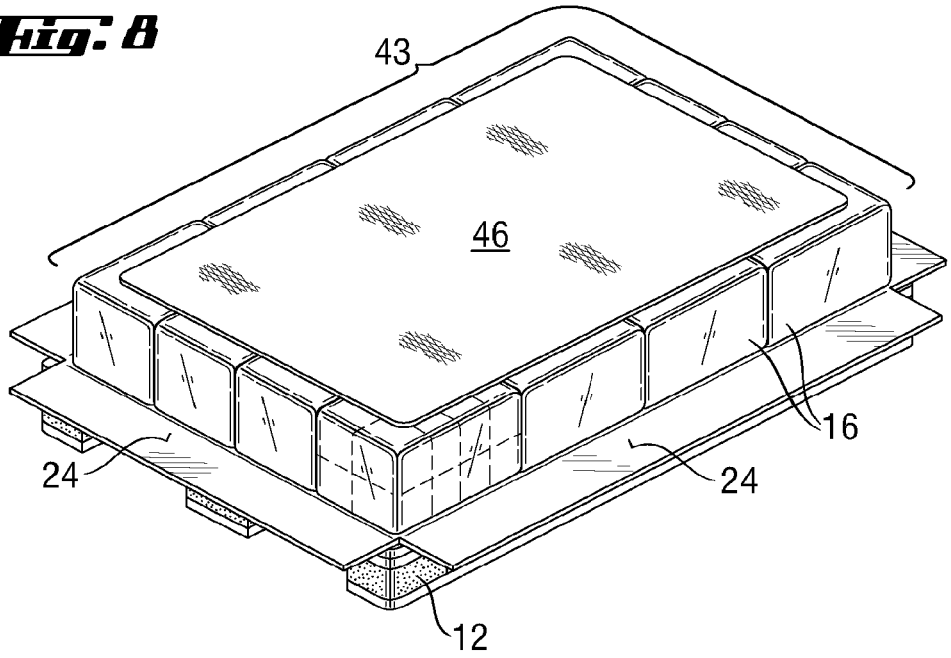
Figure 9:
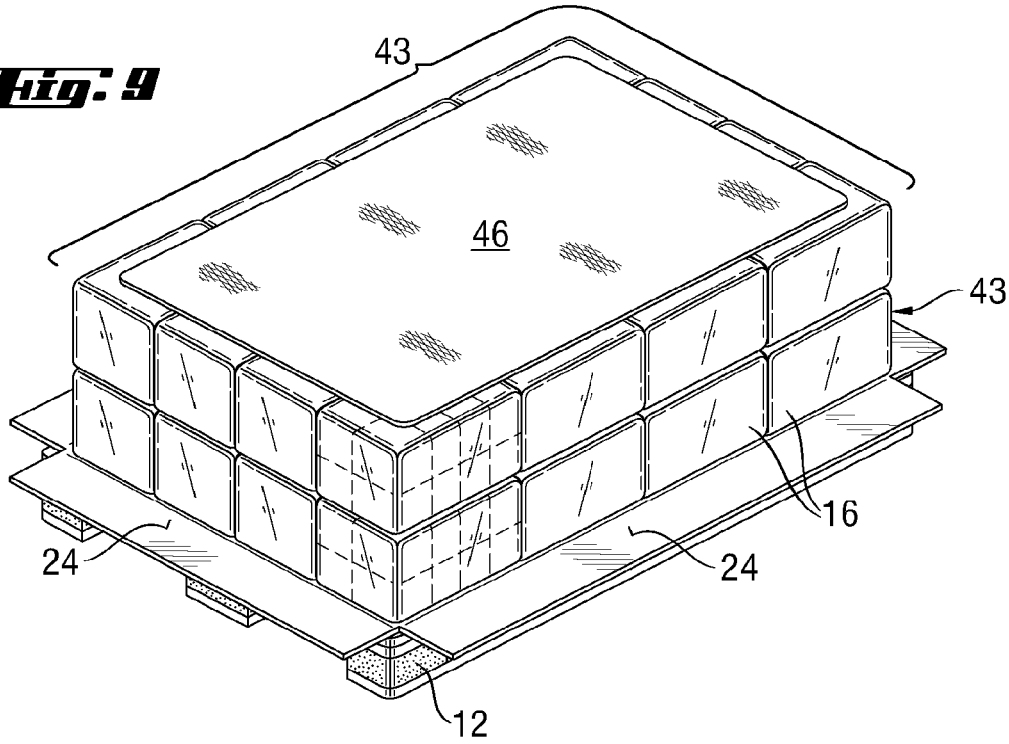

As shown on FIG. 7, a first layer 43 of secondary packages 16 may be placed on the central body of the bottom tray 18, with the side flaps 24 in their horizontal configuration. FIG. 8 to 10 show how the stack 14 of secondary packages 16 is gradually built, by stacking layer 43 upon layer 43. This may be manually done or by machine means. The stack 14 may also be placed in a single step over the bottom tray if a machine is provided with this capacity. One or more anti-slip sheets 46 may be optionally placed intermediate one, several, or all the layers of secondary packages, and between the first layer and the bottom tray. Such anti-slip sheet may be made of any material that can provide anti-slip properties, for example a sheet of paper, optionally with a rubber coating, which can help restraining the horizontal movements of the secondary packages.

Figure 11:
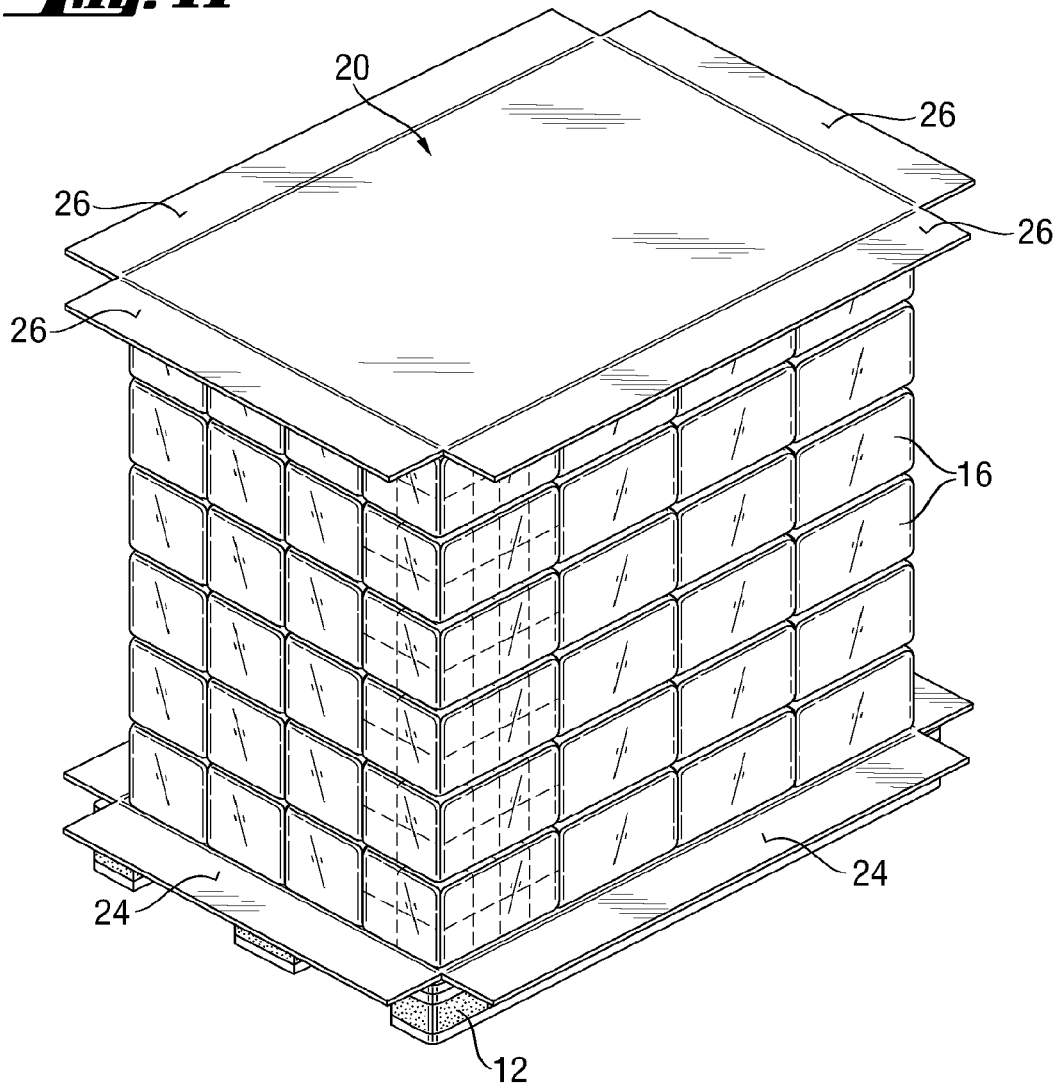

As shown on FIG. 11, the top cap 20 may be placed directly above the stack 14 of secondary packages. The top cap may 20 be of the same general construction as the bottom tray 18, as discussed above. The bottom tray 18 and top cap 20 may be generally identical and thus be used interchangeably, reducing the number of different parts necessary for the construction of the unit load, and thus reducing costs and complexity.

Figure 12A:
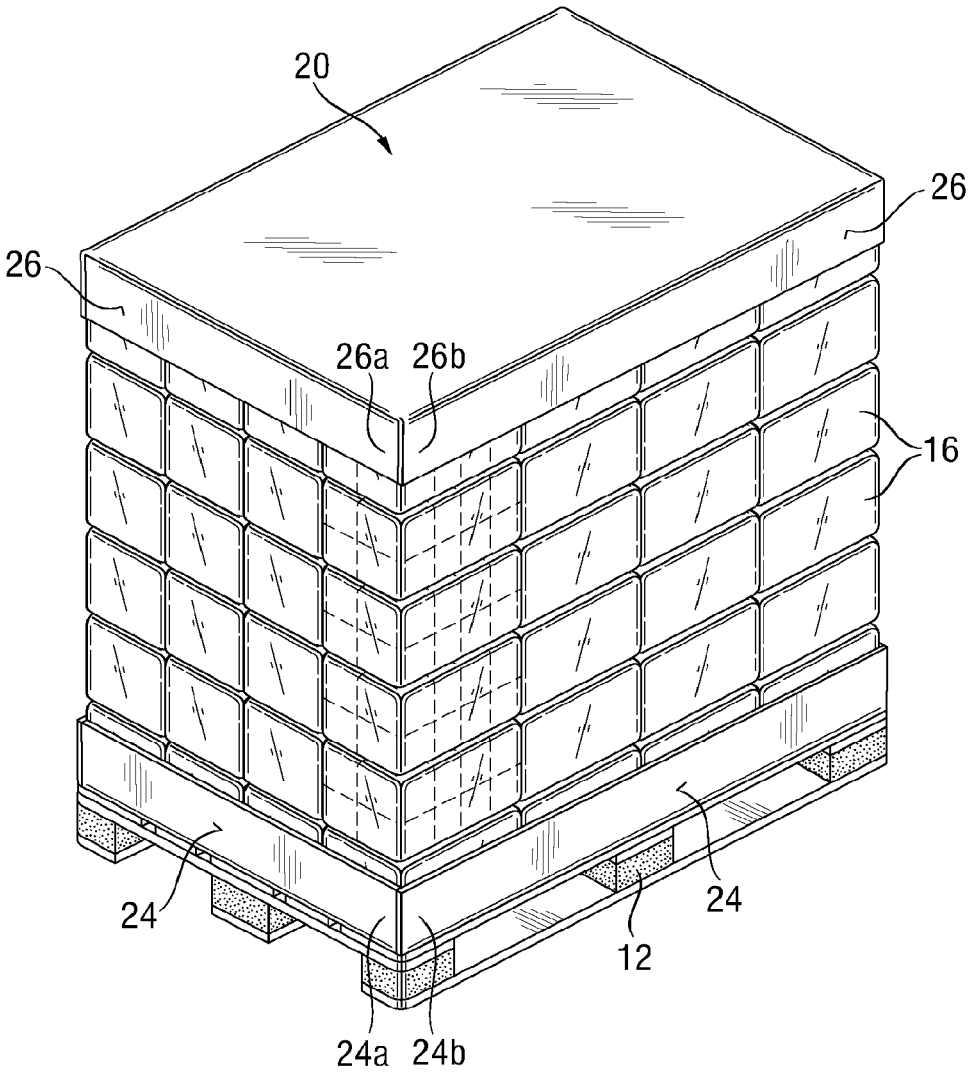
Figure 12B:
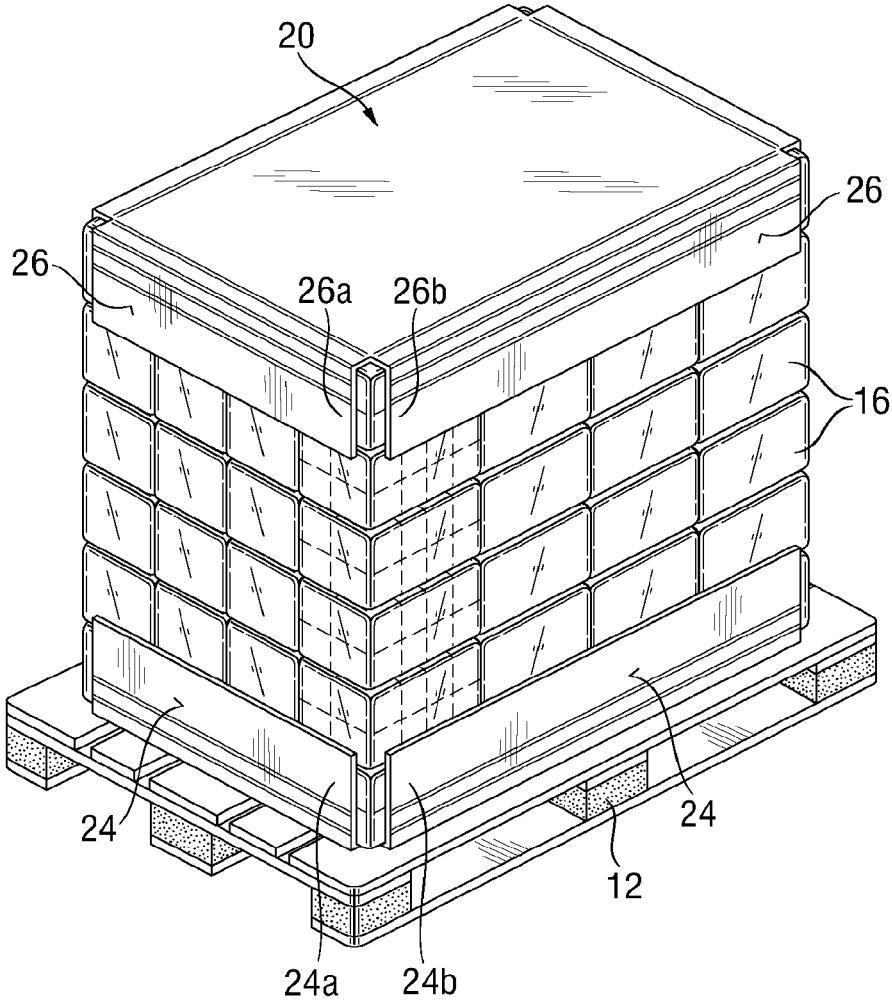

As shown on FIG. 12*a*, the side flaps 24, 26 may be then folded around one or more, advantageously all four, of the sides of the bottom edge 141 and top edge 142 of the stack 14 of secondary packages 16. The side flaps 24 of the bottom tray 18 are generally folded upwardly, normally at an about 90° angle relative to the central body 44 of the bottom tray 18. The side flaps 26 of the top cap 20 are generally folded downwardly, normally at an about 90° angle relative to the central body of the top cap. The folding of the flaps may be done manually or by a machine. FIG. 12*b* shows an embodiment wherein a bottom tray 18 as represented in FIG. 6*b* is used and a stack with smaller footprint than the surface of the pallet is used. As discussed above, crease lines 47 on the flaps may be helpful, but this is not required.

Figure 13A:
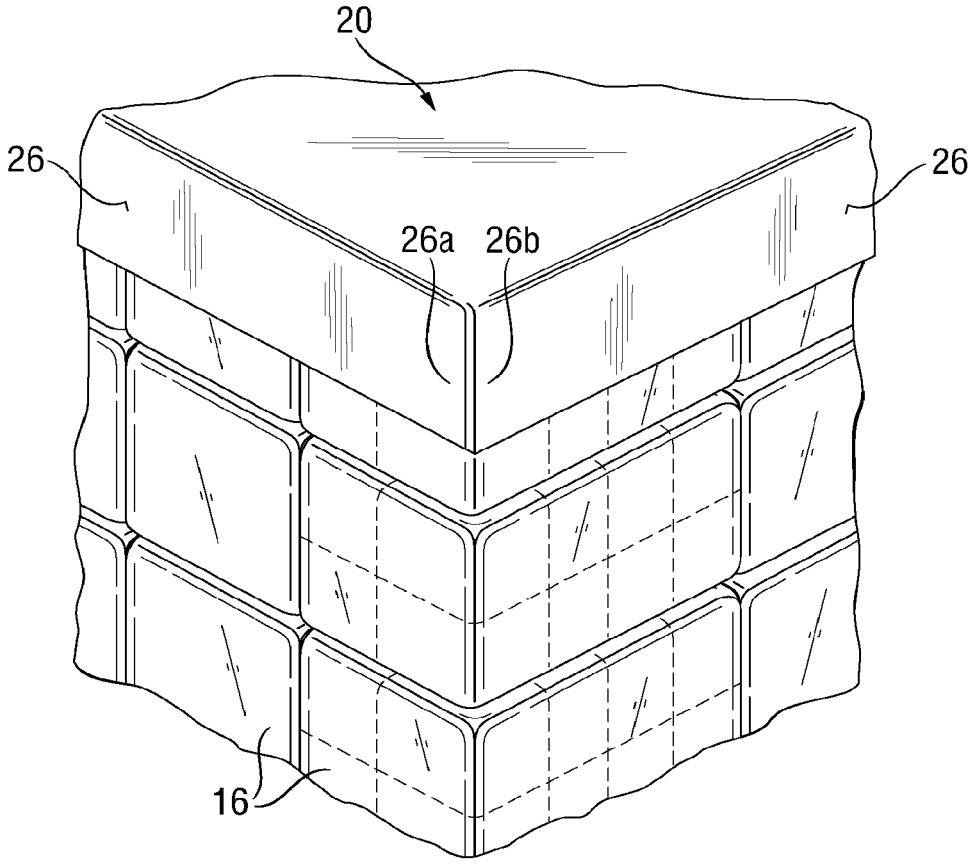
Figure 13B:
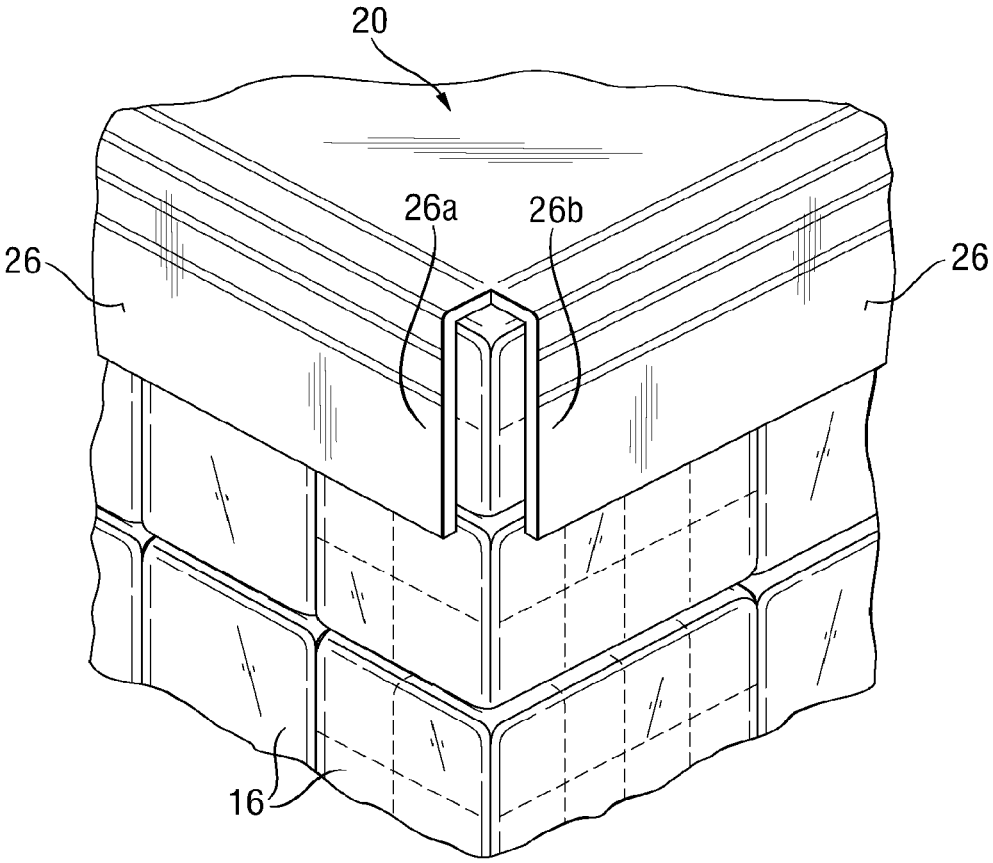

FIG. 13*a* and FIG. 13*b* show an enlarged view of an upper corner of the unit load of FIGS. 12*a* and 12*b* respectively. The folded flaps advantageously form together with the rest of the top cap on each corner of the stack 14 a relatively rigid corner comprising a portion 26*a*, 26*b* of each flap forming this corner. As shown on FIG. 13*b*, this relatively rigid corner may have a gap between the portions 26*a*, 26*b* of each flap. This corner (independent of whether it is on the bottom tray or top cap) may be relatively rigid because the material of the bottom tray and top cap, for example corrugated fiberboard, is generally more rigid than the secondary packages and the absorbent articles. The corners 24*a*, 24*b*, 26*a*, 26*b* formed by the folded flaps 24, 26 of bottom tray and top cap may serve as a top and bottom anchorage points for the vertical corner posts 22, as will be discussed below.

Figure 14:
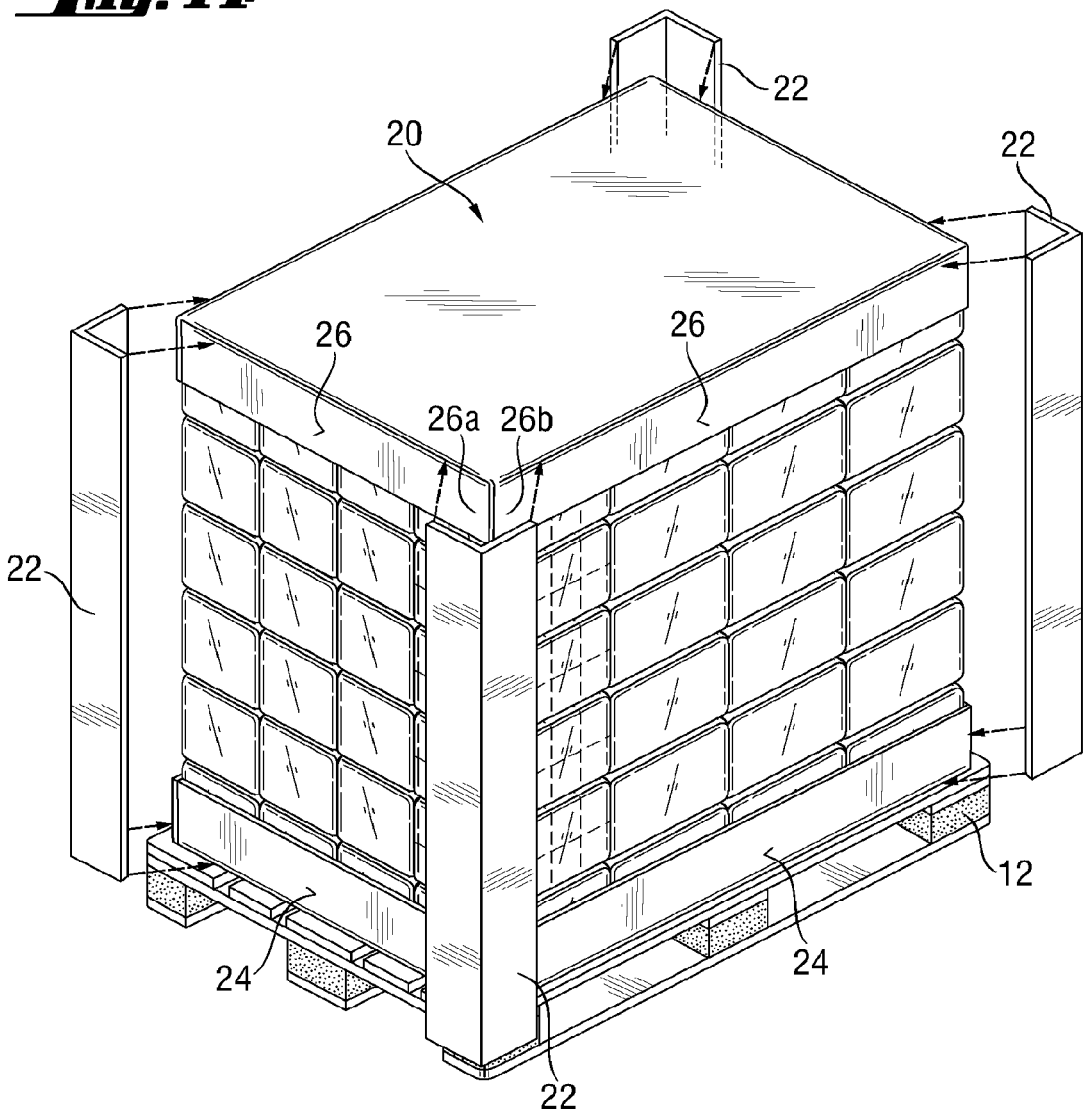

FIG. 14 illustrates the step of placing the vertical corner posts 22 along the vertical corners 143 of the stack 14 of secondary packages 16. Advantageously, each of the four corners 143 of the stack 14 is provided with one corner post 22. However a lower number of corner posts may be used, for example for cost saving reasons, but this may lower the stability of the unit load. The corner posts 22 may be made of any suitable material, as described above.

The corner posts are placed against at least a portion 24*a*, 24*b*, 26*a*, 26*b* of the folded flaps 24 of the bottom tray 18 and the folded flaps 26 of the top cap 20 respectively. The corner posts 22 are advantageously placed after the bottom tray and top cap side flaps 24, 26 have been folded, so that the inner side of the corner posts 22 is placed against the external side of the folded flaps 24, 26, in an overlapping position. This provides better stability and the corner posts are easier to place than if the corner posts were first placed along the vertical corners of the stack of secondary packages and then folding the side flaps, but this is also a possibility. The corner posts 22 may be placed along the vertical corners of the stack by hand or by a machine, simultaneously or one after the other.

Figure 15:
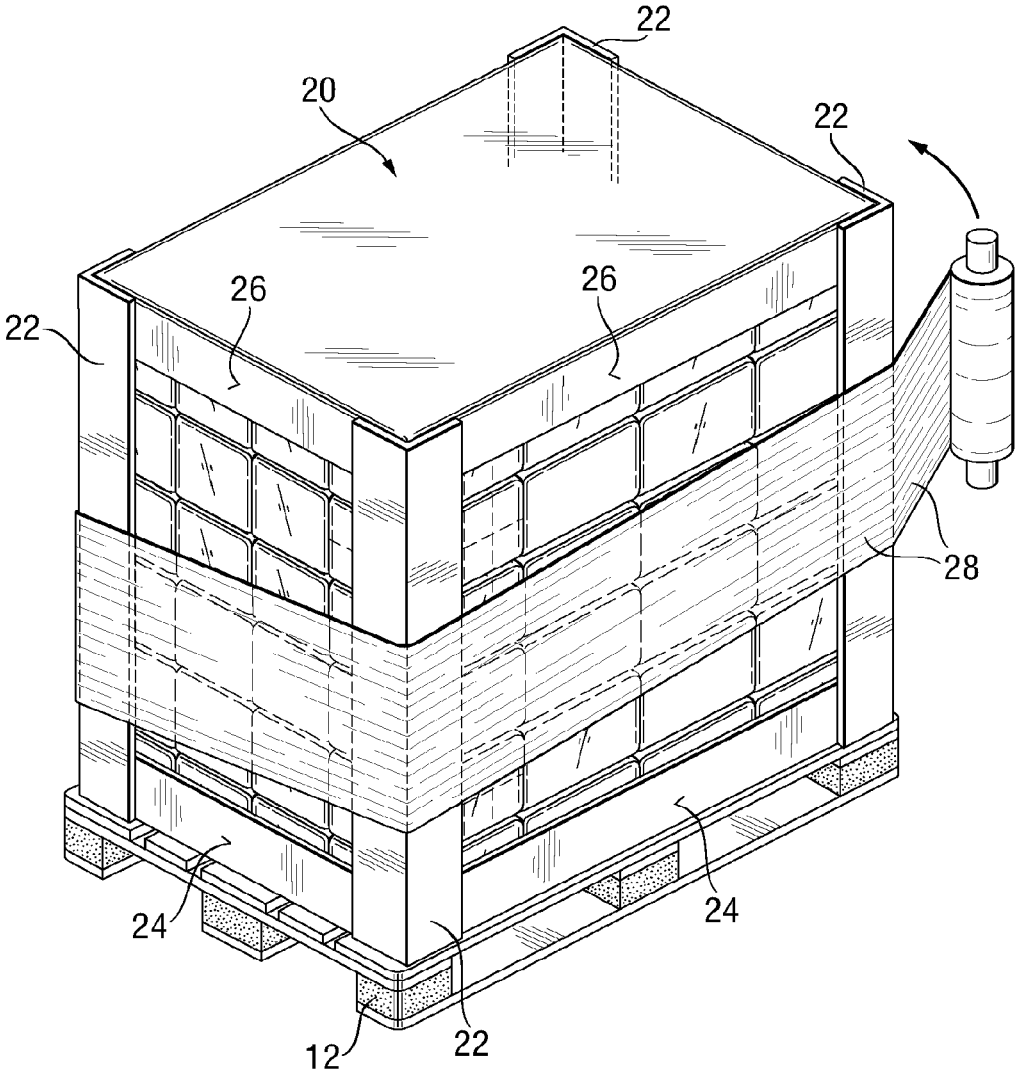

Various means may be used to maintain the corner posts 22 in position once they have been placed along the vertical corners 143 of the stack. For example, as represented in FIG. 15 a stretch wrap or shrink wrap 28 may be wrapped around the unit load construction, and thus maintain the integrity of the unit load during storage and transportation. A shrink hood may also be used. The corner posts 22 may be maintained in position against the vertical corners of the stack 14 by a stretch wrap or shrink wrap 28. Advantageously, a stretch wrap film may be used.

It may be advantageous that the corner posts 22 are only maintained in place by the stretch wrap film or shrink wrap 28, so that when the stretch wrap or shrink wrap is removed, the corner posts can be immediately removed from the corner of the stack or even fall by themselves. However, it is also possible to have the corner posts maintained in position by other or additional means, such as gluing or stapling them to the portions 24*a*, 24*b*, 26*a*, 26*b* of the folded flaps against which they are placed.

Figure 16A:
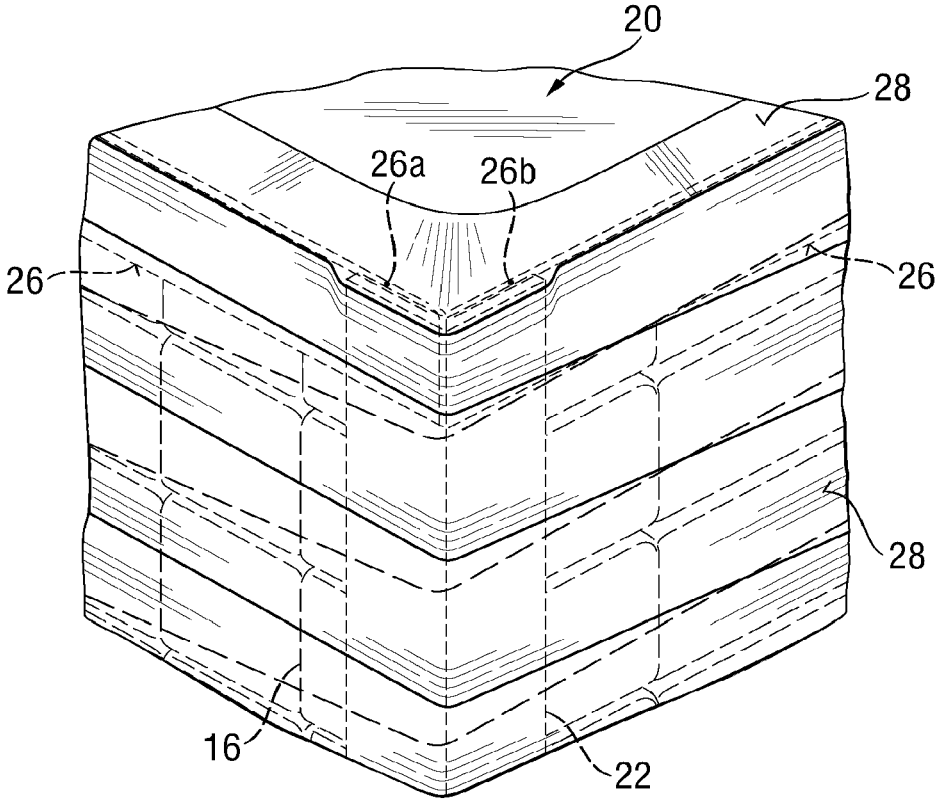
Figure 16B:
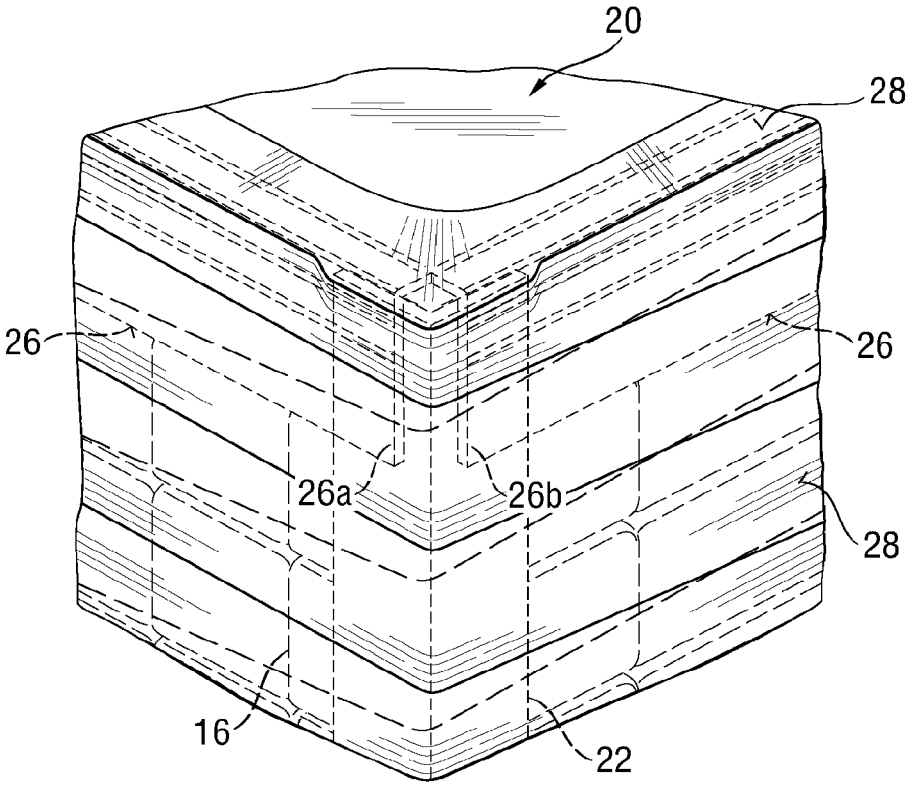

FIG. 16*a* shows a close-up view of one of the top corner of the unit load with the stretch wrap 28 in place. FIG. 16*b* shows a similar view for the embodiment of FIG. 13*b*, wherein the stack's footprint 14 is smaller than the surface of the pallet 12 and a versatile bottom tray and top cap as shown on FIG. 6*b* is used to provide better fit between the bottom tray and top cap and the stack.

Figure 17:
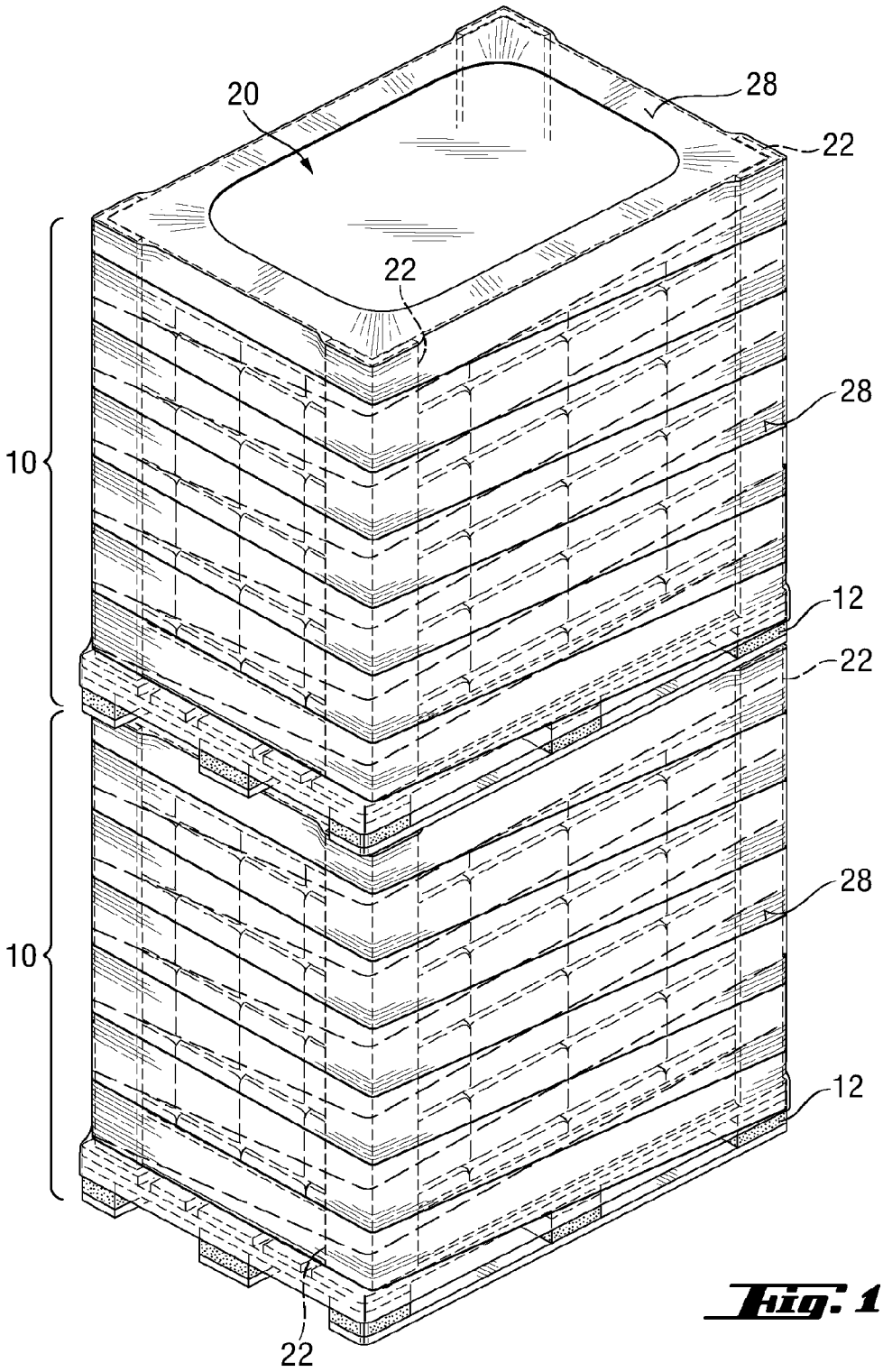
FIG. 17 is a perspective view of two unit loads of the present invention with one placed on the other, as what may be found in a storage area.

FIG. 17 shows two unit loads according to the invention wherein a second unit load is placed on top of a second unit load. Thanks to the system of the invention, the weight of the second unit load is primarily, and advantageously exclusively, supported by the corner posts of the first unit load and the absorbent hygiene articles in the flexible secondary package of the first unit load are not unduly crushed by the weight of the second unit load.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The invention claimed is:

1. A unit load for the transport of absorbent hygiene articles, comprising:

a pallet, a plurality of stackable secondary packages comprising a cuboid shape loaded on the pallet, wherein each of said secondary packages contains a plurality of primary packages each primary package containing at least eight to about sixty absorbent feminine hygiene articles, wherein each said secondary package is made of a flexible material, wherein said secondary packages fully encase the plurality of primary packages, wherein said plurality of secondary packages forms a stack, wherein said stack has a bottom edge, a top edge and a plurality of vertical corners, a bottom tray between the pallet and the stack, wherein said bottom tray comprises one or more side flaps that are folded upwardly around one or more sides of the bottom edge of the stack, a top cap disposed on top of the stack, wherein said top cap comprises one or more side flaps that are folded downwardly around one or more sides of the top edge of the stack, a plurality of vertical corner posts each placed along a different vertical corner of the stack and extending vertically at least from the bottom edge to the top edge of the stack, wherein each corner post is placed against at least a portion of the folded flaps of the top cap and against at least a portion of the folded flaps of the bottom tray, wherein the internal side of each of the vertical corner posts is placed overlapping the external side of the folded flaps and wherein the vertical corner posts are only maintained in position against the stack by a stretch wrap or shrink wrap.

2. A unit load according to claim 1 wherein a secondary package is made of a plastic film.

3. A unit load according to claim 1 wherein the bottom tray comprises one side flap folded upwardly for each side of the bottom edge of the stack and the top cap comprises one side flap folded downwardly for each side of the top edge of the stack.

4. A unit load according to claim 1, wherein each of the absorbent hygiene articles has a length and a width, the hygiene articles capable of being folded, wherein the hygiene articles are folded and placed in a folded position in the primary package, the folded absorbent hygiene article length is vertically oriented.

5. A unit load according to claim 1, wherein the stack is made of several layers of secondary packages, and wherein an anti-slip sheet is placed between at least two of these layers.

6. A unit load according to claim 1 wherein the primary package is made of a plastic film.

7. A unit load according to claim 1, wherein each of the absorbent hygiene articles has a length and a width, the hygiene articles capable of being folded, wherein the hygiene articles are not folded and placed in an unfolded position in the primary package, the width of the absorbent hygiene articles is vertically oriented.

8. A stackable secondary package comprising a cuboid shape containing a plurality of primary packages, each of said primary packages containing at least eight to about sixty feminine hygiene articles, wherein said secondary packages fully encase the plurality of primary packages, and wherein the secondary package is made of a flexible material plastic film.

9. A secondary package according to claim 8, wherein the secondary package comprises a pre-ruptured line, which defines a removable portion of the secondary package.

10. A method for making a unit load for the transport of absorbent hygiene articles comprising the steps of:

providing a pallet;

placing a bottom tray in a flat configuration on the pallet, wherein said bottom tray has one or more side flaps extending outwardly;

loading the bottom tray with a plurality of stackable secondary packages comprising a cuboid shape, wherein each of said secondary packages contains a plurality of primary packages each primary package containing at least eight to about sixty feminine hygiene articles, wherein said secondary packages fully encase the plurality of primary packages, wherein said secondary package is made of a flexible material, wherein said plurality of secondary packages forms a stack, wherein said stack has a bottom edge, a top edge and a plurality of vertical corners, placing a top cap in a flat configuration on top of the stack wherein said top cap comprises one or more side flaps that extend outwardly;

folding the side flaps of the bottom tray upwardly around one or more sides of the bottom edge of the stack;

folding the side flaps of the top cap downwardly around one or more sides of the top edge of the stack;

placing a plurality of vertical corner posts each along a different vertical corner of the stack, wherein the internal side of each of the vertical corner posts is placed overlapping the external side of the folded flaps, wherein each vertical corner post extends vertically at least from the bottom edge to the top edge of the stack, wherein the corner posts are placed against at least a portion of the folded flaps of the top cap and at least a portion of the folded flaps of the bottom tray;

maintaining the vertical corner posts in position along the vertical corners of the stack only by a stretch wrap or shrink wrap.

11. A method according to claim 10 wherein a secondary package is made of a plastic film.

12. A method according to claim 10 wherein the bottom tray comprises one side flap folded upwardly for each side of the bottom edge of the stack, and the top cap comprises one side flap folded downwardly around each side of the top edge of the stack.

* * * * *